US006255786B1

(12) United States Patent
Yen

(10) Patent No.: US 6,255,786 B1
(45) Date of Patent: Jul. 3, 2001

(54) LIGHT EMITTING DIODE LIGHTING DEVICE

(76) Inventor: George Yen, 2F, 15, Alley 11, Lane 327, Sec. 2, Chung Sun Rd., Chung Ho, Taipei (TW)

( * ) Notice: Subject to any disclaimer, the term of this patent is extended or adjusted under 35 U.S.C. 154(b) by 0 days.

(21) Appl. No.: 09/552,005

(22) Filed: Apr. 19, 2000

(51) Int. Cl.[7] ..... H05B 37/02

(52) U.S. Cl. ..... 315/291; 315/292; 340/825.07; 340/825.18; 362/800

(58) Field of Search ..... 315/291, 292, 315/293, 317, 318; 340/815.45, 825.07, 825.18; 362/800

(56) References Cited

U.S. PATENT DOCUMENTS 5,307,058 * 4/1994 Tokizane et al. ..... 340/825.07
5,420,482 * 5/1995 Phares ..... 315/292
6,133,844 * 10/2000 Ahne et al. ..... 340/815.45
6,150,774 * 11/2000 Mueller et al. ..... 315/291
6,161,910 * 12/2000 Reisenauer et al. ..... 362/800
6,166,496 * 12/2000 Lys et al. ..... 315/292
B1 6,188,181 * 2/2001 Sinha et al. ..... 315/293

* cited by examiner

*Primary Examiner*—Don Wong
*Assistant Examiner*—Thuy Vinh Tran
(74) *Attorney, Agent, or Firm*—Dougherty & Troxell

(57) ABSTRACT

A light emitting device utilizing a plurality of light emitting diodes (LEDs). LEDs with R/G/B colors are specially arranged to obtain a better light mixing effect. A specially designed heat sink structure is provided to enhance the heat dissipation of LEDs so as to increase the LED density, to decrease its volume and to elongate its lifetime. Furthermore, a newly designed network buffer means is provide for easy connection of the LED system.

6 Claims, 5 Drawing Sheets

LIGHT EMITTING DIODE LIGHTING DEVICE

BACKGROUND OF THE INVENTION

1. Field of Invention

The present invention generally relates to a light emitting diode (LED) lighting device.

2. Related Art

When a plurality of light emitting diodes (LEDs) of the same color or different colors are connected in series into several series of LEDs, it is likely to have different VF values in individual LEDs (1.8 V to 2.1 V for red ones and 3.6 V to 4.0 V for blue and green ones) which result in uneven electric currents. This phenomenon of uneven electric currents would damage LEDs with larger currents flowing through and make LEDs with smaller currents unable to have sufficient luminosity.

Since the relation between the luminosity of the LED and the electric current flowing through is not linear. In the prior art, the control of the LED luminosity can only be achieved by changing the duty cycle of lighting the LEDs. This technology has been widely used in LED signs for over 20 years and become a fairly mature technology.

The above-mentioned control can be achieved by a software program performed on a microprocessor, a digital logic circuit, or a devoted integrated circuit (There are already IC factories designing and producing this type of ICs for LED signs). A PWM logic circuit 120 composed of digital devices can increase the frequency of the lighting cycle of the LED. The software control through a microprocessor can only go up to 350 Hz (i.e. a repetition rate of 350 times per second). This frequency can not be perceived by naked eyes. However, from a camera one can apparently see the blinking. This blinking can even be observed by a relative motion between the eyes and the lighting unit. Thus, it is bad for image production.

When a large number of LEDs are located together and arranged in one direction in a usual way, the emitted light would have speckles (i.e. uneven color mixing). The wavelength and luminosity of the light emitted from the LED of a specific color are limited by the LED production technology to certain ranges. If an equal number of red, green, and blue LEDs are employed, different electric currents have to provided for LEDs of different colors so as to obtain a light spectrum similar to the natural light. Accordingly, in the long run, LEDs with larger currents flowing through decay faster in the luminosity whereas LEDs with smaller currents flowing through decay more slowly.

Moreover, the LED also generates heat when emitting light. There is no problem in heat dissipation for a single LED. Since the luminosity of a single LED is not high enough, many LEDs have to be collected for a substantial operation power. If so, the heat generated by the LEDs would be harmful to themselves. If the heat generated by the LEDs can not be dissipated immediately, the density of LEDs can not be increased to reduce the device volume and its lifetime may be shortened.

SUMMARY OF THE INVENTION

Therefore, it is an object of the present invention to provide a light emitting diode (LED) lighting which can conquer the problem with blinking and overheating.

Digital network has a wide application in computer systems. The device also uses the digital network. However, a normal network driver can only control about 32 terminal devices. Once a plurality of devices are connected together, a proper buffer has to be inserted to increase the driving power or to extend the network outreach. Therefore, several network connection methods are proposed. Nevertheless, all network buffer circuits are designed to be fixed. Once the devices on the network are changed or rearranged, they have to be redesigned and reconnected. Since LED lighting devices has a strong mobility, fixed buffers are not suitable. Some apparatuses adopt the method of adding a buffer at each level to simplify the connection complexity, yet this method still has some danger because once some device is out of order, all devices after it are disconnected from the network and cannot work.

Furthermore, any device on the network system needs an independent address while installation. This is very inconvenient in certain circumstances. Another function of the present invention is to allow the main control system to send out an address update command after the network and all devices finish installation for each device to setup its address on its own without assigning individually.

BRIEF DESCRIPTION OF THE DRAWINGS

The present invention will be described with reference to the accompanying drawings of which.

DETAILED DESCRIPTION OF THE INVENTION

The present invention is designed by the research and development groups of our company by accumulating decades of experience and the application of the latest light emitting diode (LED) technology in LED signs. Most of the base devices are derived from the LED sign system.

Figure 1:
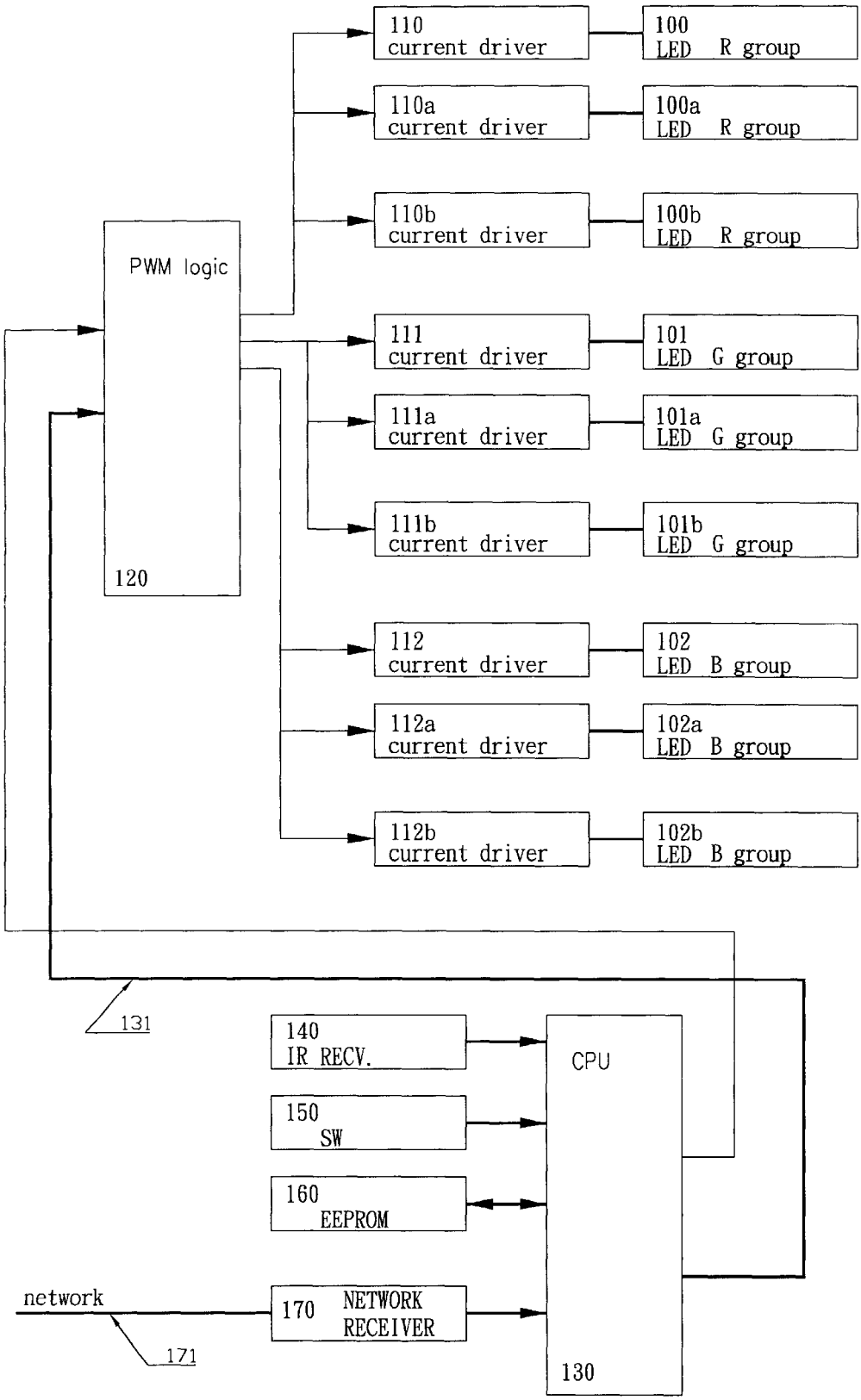
FIG. 1 is a structural block diagram of the present invention.

FIG. 1 is a structural block diagram of the present invention. The invention comprises three groups of LEDs in red, green and blue 100,101,102, three groups of electric current driving circuits 110,111,112, a PWM wave generator logic circuit composed of digital components 120, a small microprocessor 130, an infrared (IR) receiver 140, a button switch 150, nonvolatile memory 160, and a digital network receiver 170.

LEDs of each color are connected in series into several series of LEDs 100, 100*a*, 100*b*, 101, 101*a*, 101*b*, 102, 102*a*, 102*b*, each of which is driven by an individual electric current driving circuit 110, 110*a*, 110*b*, 111, 111*a*, 111*b*, 112, 112*a*, 112*b*. This can prevent the phenomenon of uneven electric currents due to different VF values of individual LEDs(1.8 V to 2.1 V for red ones and 3.6 V to 4.0 V for blue and green ones) when connected in parallel.

As described in the background, the luminosity of the LED is not linearly proportional to the electric current flowing through. In the prior art, the control of the LED luminosity can only be achieved by changing the duty cycle of lighting the LEDs. This technology has been widely used in LED signs for over 20 years and become a fairly mature technology. The control can be achieved by a software program performed on a microprocessor, a digital logic circuit, or a devoted integrated circuit (There are already IC factories designing and producing this type of ICs for LED signs). A PWM logic circuit composed of digital devices can increase the frequency of the lighting cycle of the LED. The software control through a microprocessor can only go up to 350 Hz (i.e. a repetition rate of 350 times per second). The present invention utilizes a devoted digital logic circuit 120 to generate PWM signals with the frequencies above 30,000 Hz. This then provides a steady, non-blinking light source. Also, since the burden of the CPU is reduced (more than 80% working time of the high level CPU would be occupied for generating PWM signals using the microprocessor), thus a lower level microprocessor can be employed to increase the system stability.

Since a digital logic circuit is adopted to generate PWM signals, the microprocessor 130 of the present invention can devote to receiving display messages transmitted from a network receiver 170, converting the messages into serial or parallel signals 131 required by the digital logic circuit 120 and sending to the digital logic circuit 120. A digital network usually contains more than two devices working together, thus the microprocessor 130 determines the order or method of reading data from the net through the network receiver 170 according to relevant information stored in EEPROM 160. This is somewhat like defining addresses, yet the present method is more flexible because the contents of the EEPROM 160 can be updated by following a specific procedure via a digital network. It is not like those devices which define addresses by manually setting switches or other mechanical methods. The invention further comprises an infrared (IR) receiver 140 so the operator can enter some commands to change the function mode of the device via an IR keyboard. These commands are stored into the EEPROM 160 after entering confirmation to be the reference for the next starting of the device. Since the device of the present invention is normally installed at places that people can not reach by hands, the IR setting become more convenient. Furthermore, IR input devices can be more easily made to be waterproof than usual mechanical ones, so this is an advantage of the present invention when waterproof is needed.

The button switch 150 in FIG. 1 is an auxiliary setting, which is usually used for making initial setup of newly built models in the factory and is of no use after being installed.

The above-mentioned operations and functions can be completed by a software program on a microprocessor 130. Modifying the software program can change the functioning method and order.

Figure 2:
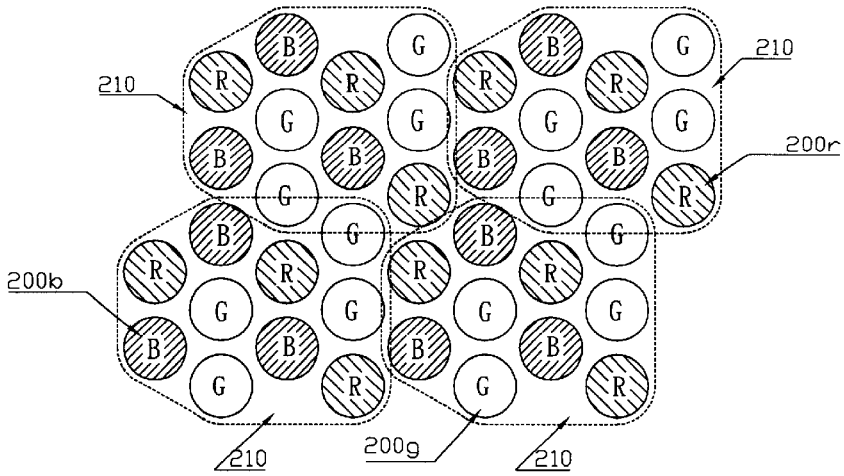
FIG. 2 is a schematic view of an LED arrangement according to the present invention.

If a large number of LEDs are place together without special arrangement, the light emitted therefrom usually has speckles (i.e. uneven color mixing). Our research team made hundreds of arrangements and actual tests and finally determined that the arrangement shown in FIG. 2 has the least speckles. Therefore, the present invention uses the most proper ratio R:G:B=3:4:3 to make the electric currents flowing through all color LEDs close to one another. The LED arrangement in FIG. 2 follows this principle. 10 LEDs as a unit 210 form a base arrangement unit, which includes 3 red LED, 3 blue LEDs, and 4 green LEDs. The whole LED lighting unit is made up by following this rule. Each LED is separated from one another by 5.9 mm to 6.1 mm, which is determined to be the best spacing for machining process thermal density and the device size.

Figure 3:
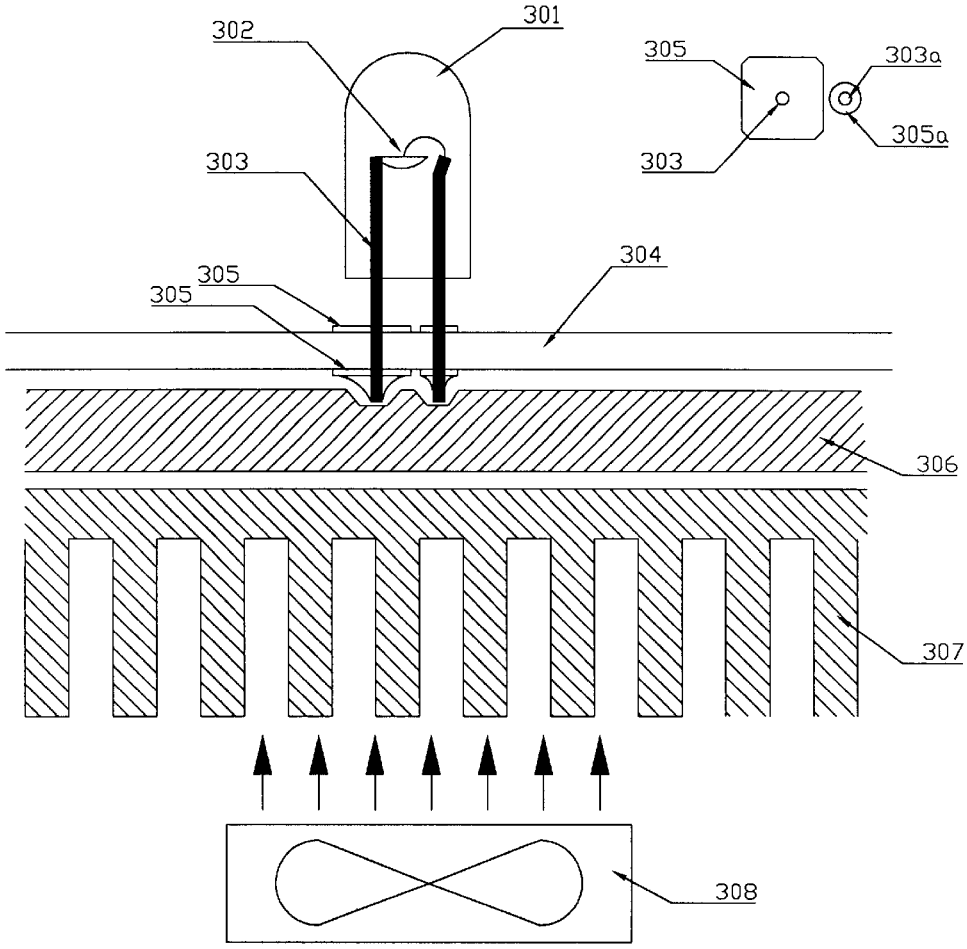
FIG. 3 is a cross-sectional view of a lamp base with the LED heat dissipation according to the present invention.

The present invention has a good improvement in heat dissipation due to the lighting of the LED lighting device. The invention adopts the passive and active methods for heat dissipation. The passive heat dissipation is shown in the cross-sectional view of a lamp base with the LED heat dissipation as in FIG. 3. A chip 302 is the LED 301 is the object that radiates light and heat. The heat would be spread out via a metal wire 303. This metal wire is the so-called hot pole. The metal wire 303 of the LED 301 is welded onto a solder pad 305 of a circuit board 304. The whole circuit board 304 gets in contact with a heat sink 307 (usually aluminum) using a soft thermal conducting silicon chip 306 as the medium. All the heat generated on the LED 301 is readily spread to the ambient air. To speed up the heat transfer on the chip 302, the solder point of the hot pole on the PCB layout can be enlarged so as to increase the contact area of the solder point 305 and the heat pad 306. Therefore, the heat transfer rate can be increased.

In addition, when collecting more LEDs 301 on a larger lighting device, it is not so easy to have heat dissipation purely by radiation from the heat sink 307 to the air. An active heat device, a fan 308 can be included to facilitate the heat dissipation.

Figure 4:
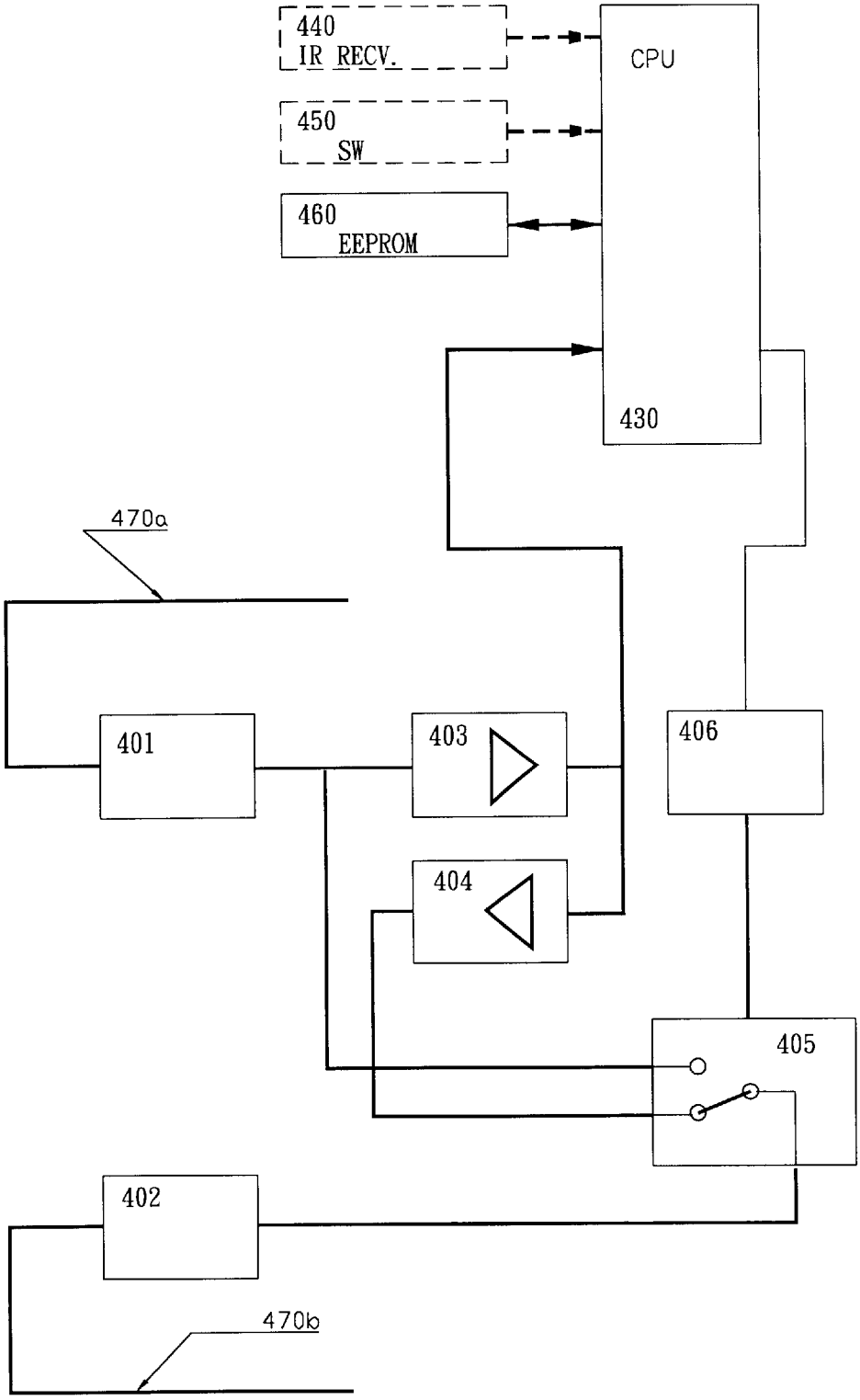
FIG. 4 is a block diagram of the digital network applied to the present invention.

The device according to the present invention provides a resolution to the problems existing in a conventional digital network. As the block diagram of the digital network applied to the present invention shown in FIG. 4, the device comprises a set of in-connectors 401, a set of out-connectors, a set of network receiving circuits 403, a set of network buffers 405, a set of relays 405, and a set of relay driving circuits. When the relay 405 is not active, the out-connector 402 is directly connected to the in-connector 401. This device is simply connected to the network. When the relay 405 actions, the connector 402 is connected to the network receiver 403 through a network buffer 404 and a relay 405. It is equivalent to have a network buffer insert into the network. The driver 406 for controlling the relay 405 is preprogrammed to action at a proper time according to the rules set by a microprocessor. Taking the LED lighting device of the present invention as an example, a unit needs three addresses (corresponding to R/G/B colors) and the network driver can drive 32 devices. Therefore, the rules can be set as when the device addresses are defined at 0, 96, 192, 288, 384 . . . , the network buffer of the device automatically join the network so that the network can be indefinitely extended and at the same time the high reliability can be guaranteed.

Figure 5:
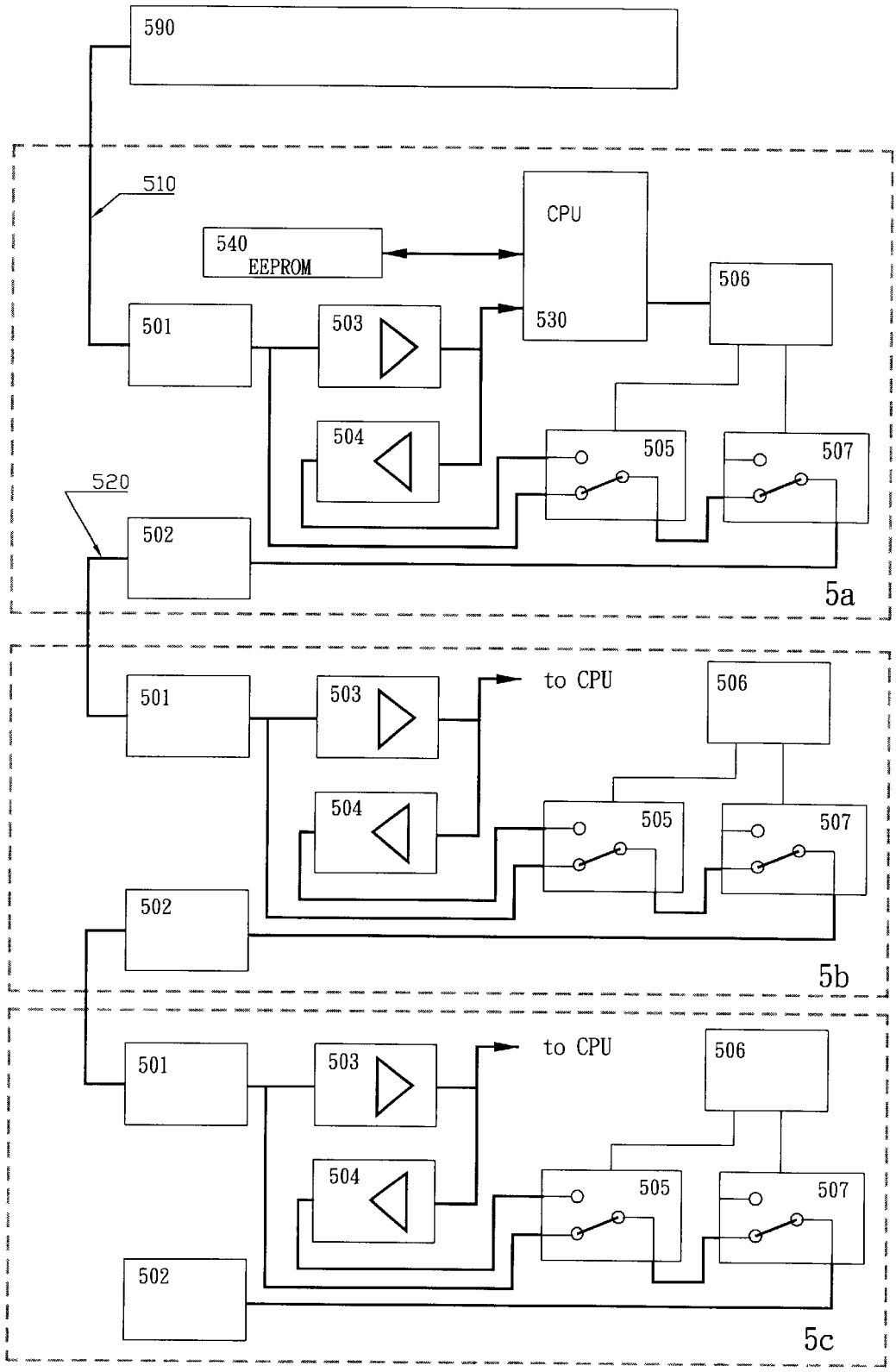
FIG. 5 is a block diagram showing the network system functioning principles according to the present invention.

Each independent address set by any device on the network of the present invention is defined by itself after all device installations are completed and the main control system sends out the address update command. It is not necessary to set the addresses individually. FIG. 5 depicts a block diagram showing the network system functioning principles according to the present invention. There is one more relay 507 in FIG. 5 than in FIG. 4, but the rest is the same as FIG. 4. The new relay 507 mainly separates the connector 502 from the network so that the devices thereafter 5*b*, 5*c* can not receive network signals. When the power is just turned on or the device receives some command from the network, the microprocessor 509 controls the relay 507 to action and to separate the connector 502 from the connector 501. The network signals sent by the main control system 520 can only reach the first device 5*a*. The main control system 520 can give the address setting command to the first device 5*a* via the network 510. The microprocessor 509 in the device then stores the address to EEPROM 508 for future reference and restores the relay 507 so as to connect the network to the next device 5*b*. Since the second device 5*b* has not received any command, it is still in the standby state. Thus, the second address setting command given by the main control system 520 would reach the second device 5*b*, but not the third device 5*c*. As such process goes on, the main control system 520 can perform address settings for all devices installed on the network. This kind of device does not need to take into account the settings of each device while installation. The main control system sends out a setting command after all installations are completed. So the whole system building can be speeded up.

Figure 6:
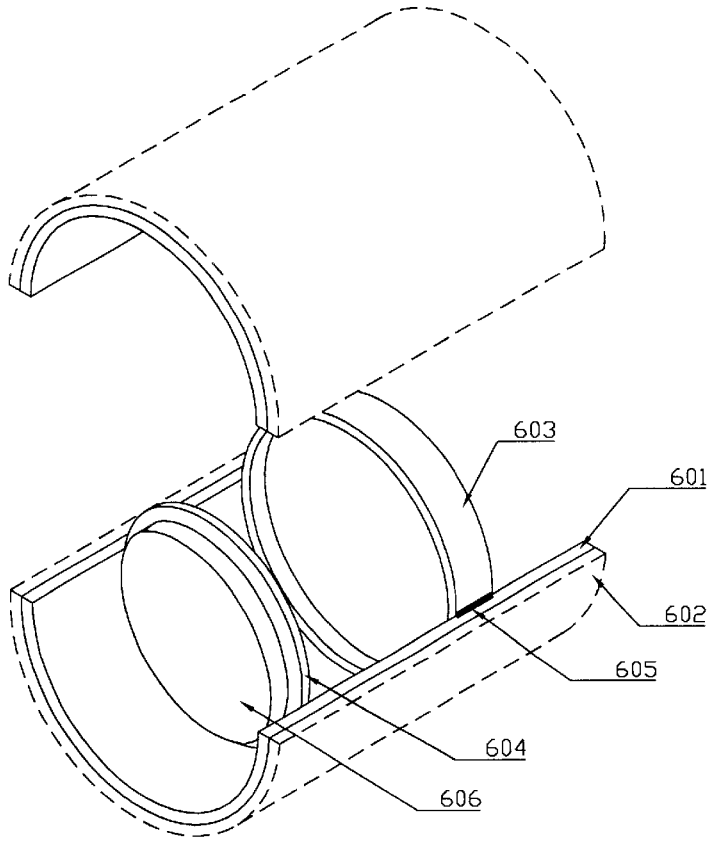
FIG. 6 is a three-dimensional view of a embodiment lamp base with a water proof structure according to the present invention.
Figure 7:
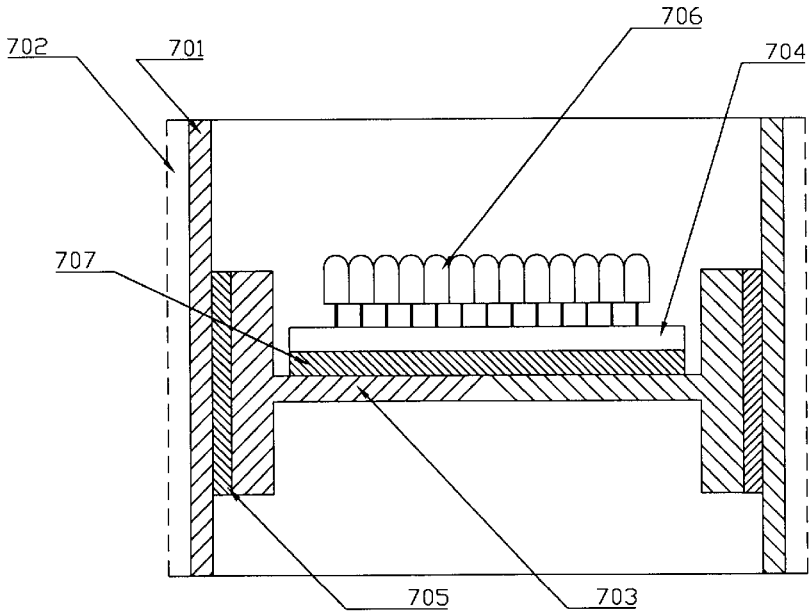
FIG. 7 is a cross-sectional view of a embodiment lamp base with a waterproof structure according to the present invention.

The present invention provides a structure that can facilitate heat dissipation. Aside from heat dissipation, the structure also provide a structure that is waterproof and can be assembled quickly. Referring to FIGS. 6 and 7, the structure comprises two semispherical main heat sinks 601, 701 which are formed with fins 602, 702 to increase the surface area and an aluminum cup connected back to back 603, 703. Soft heat conducting rubbers 605, 705 are inserted between the main heat sinks 601, 701 and the aluminum cups 603, 703 to facilitate heat transfer and to lower the imperfect heat contact between the two objects 701 and 703 due to machining errors. The LED lighting units 606, 706 are assembled via soft heat conducting rubbers 607, 707 on the aluminum cups 603, 703. The heat generated by the LED can be immediately dissipated. The reason for using cup shape elements is to increase the heat contact area without increasing the weight of materials (as compared with using thick aluminum plates).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A light emitting diode (LED) lighting device, which comprises:

a lighting unit composed of a set of specifically arranged red/green/blue (R/G/B) LEDs;

a set of heat dissipation assembly;

three groups of electric current driving circuits;

a programmed central controller, which can read a serial signals according to an assigned order from a digital network and convert them into parallel ones or serial ones in other format;

a high speed PWM control element composed of a hardware logic circuit;

a set of infrared (IR) receiver and digit display; and a set of EEPROM for storing all parameters needed in the operation of the lighting device, the parameters being setup by the set of IR receiver and digit display according to a predetermined operation order.

2. The lighting device according to claim 1, wherein the ratio of the numbers of the R/G/B LEDs is R:G:B=3:4:3.

3. The lighting device according to claim 1, wherein the heat dissipation assembly includes an enlarged LED hot pole pad on the circuit, a soft heat conducting rubber, and a metal heat conducting element, the enlarged hot pole pad can increase the heat transfer.

4. The lighting device according to claim 1, wherein the heat dissipation assembly comprises an forced air-cooling fan to speed up heat transfer and to decrease the volume of the heat dissipation element.

5. The lighting device according to claim 1, wherein the lighting device further comprises a device for automatically inserting a line buffer and a terminate resistor to a digital network, the device including:

a digital network receiver circuit, a digital network buffer circuit, a circuit relay, a relay driving controller, which can automatically add a buffer to the digital network according to predetermined conditions;

an LED address device for automatically configuring the addresses of a plurality of LEDs within the same digital network;

the LED address device further comprising:

a digital network receiver circuit, a digital network buffer circuit, a digital signal flow controller, two circuit relays; and a relay driving controller;

wherein the LED lighting device is capable of configuring automatically the network addresses of all LEDs according to the predetermined order and the main controller after the LEDs are installed.

6. The lighting device according to claim 1, wherein the heat dissipation structure comprises a set of two semispherical main heat dissipation devices with two cup shape aluminum heat elements contacted back to back in between, and a soft heat conducting rubber is inserted between the main heat dissipation devices and the aluminum contact device and between the cup shape aluminum contact device and the LED.

* * * * *